US010389039B2

(12) United States Patent
Yman et al.

(10) Patent No.: US 10,389,039 B2
(45) Date of Patent: Aug. 20, 2019

(54) ANTENNA FEEDING NETWORK

(71) Applicant: CELLMAX TECHNOLOGIES AB, Kista (SE)

(72) Inventors: Niclas J. Yman, Ekerö, MN (US); Dan Karlsson, Sollentuna (SE)

(73) Assignee: Cellmax Technologies AB, Kista (SE)

( * ) Notice: Subject to any disclaimer, the term of this patent is extended or adjusted under 35 U.S.C. 154(b) by 0 days.

(21) Appl. No.: 15/760,594

(22) PCT Filed: Sep. 15, 2016

(86) PCT No.: PCT/SE2016/050867

§ 371 (c)(1),
(2) Date: Mar. 15, 2018

(87) PCT Pub. No.: WO2017/048184

PCT Pub. Date: Mar. 23, 2017

(65) Prior Publication Data

US 2019/0044226 A1 Feb. 7, 2019

(30) Foreign Application Priority Data

Sep. 15, 2015 (SE) ..... 1551184

(51) Int. Cl.
*H01P 3/06* (2006.01)
*H01P 5/04* (2006.01)
(Continued)

(52) U.S. Cl.
CPC ..... *H01Q 21/0006* (2013.01); *H01P 5/04* (2013.01); *H01Q 1/246* (2013.01); *H01Q 21/08* (2013.01);
(Continued)

(58) Field of Classification Search
CPC .... H01Q 21/0006; H01Q 21/08; H01Q 21/26; H01Q 1/246; H01Q 3/30; H01P 5/04; H01P 5/026; H01P 3/06; H01R 2201/02
See application file for complete search history.

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Robert Karacsony
(74) *Attorney, Agent, or Firm* — The Jansson Firm; Pehr B. Jansson

(57) ABSTRACT

An antenna feeding network for a multi-radiator antenna. The feeding network comprises at least one substantially air filled coaxial line, each comprising a central inner conductor, an elongated outer conductor surrounding the central inner conductor, and an elongated rail element slideably movably arranged inside the outer conductor. The rail element is longitudinally movable in relation to at least the outer conductor.

30 Claims, 5 Drawing Sheets

(51) Int. Cl.

| | |
|---|---|
| ***H01Q 1/24*** | (2006.01) |
| ***H01Q 3/30*** | (2006.01) |
| ***H01Q 21/00*** | (2006.01) |
| ***H01Q 21/08*** | (2006.01) |
| ***H01Q 21/26*** | (2006.01) |

(52) U.S. Cl.

CPC ..... *H01P 3/06* (2013.01); *H01Q 3/30* (2013.01); *H01Q 21/26* (2013.01)

(56) References Cited

U.S. PATENT DOCUMENTS

| | | | |
|---|---|---|---|
| 2001/0048351 | A1 | 12/2001 | Love |
| 2002/0135520 | A1 | 9/2002 | Teillet et al. |
| 2002/0135527 | A1 | 9/2002 | Teillet et al. |
| 2004/0203284 | A1 | 10/2004 | Stolle et al. |
| 2004/0263389 | A1 | 12/2004 | Haunberger et al. |
| 2005/0134517 | A1 | 6/2005 | Gottl |
| 2007/0241984 | A1 | 10/2007 | Schadler |
| 2008/0139044 | A1 | 6/2008 | Hantsch et al. |
| 2010/0001811 | A1 | 1/2010 | Haunberger et al. |
| 2010/0007571 | A1 | 1/2010 | Riedel |
| 2010/0201590 | A1 | 8/2010 | Girard et al. |
| 2010/0283710 | A1 | 11/2010 | Lutman et al. |
| 2013/0088402 | A1 | 4/2013 | Lindmark et al. |
| 2014/0035698 | A1 | 2/2014 | Schadler et al. |
| 2014/0139387 | A1 | 5/2014 | Jones et al. |
| 2015/0109183 | A1 | 4/2015 | Smith |
| 2015/0180135 | A1 | 6/2015 | Jonsson et al. |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och registreringsverket Box 5055 S-102 42 Stockholm, Sweden.

PCT/SE2017/050087, International Search Report, dated May 4, 2017, Patent-och registreringsverket Box 5055 S-10242 Stockholm, Sweden.

PCT/SE2017/050087, Written Opinion of the International Searching Authority, dated May 4, 2017, Patent-och registreringsverket Box 5055 S-10242 Stockholm, Sweden.

PCT/SE2017/050088, International Search Report, dated Apr. 28, 2017, Patent-och registreringsverket Box 5055 S-10242 Stockholm, Sweden.

PCT/SE2017/050088, Written Opinion of the International Searching Authority, dated Apr. 28, 2017, Patent-och registreringsverket Box 5055 S-10242 Stockholm, Sweden.

PCT/SE2017/050618, International Search Report, dated Aug. 30, 2017, Patent-och registreringsverket Box 5055 S-10242 Stockholm, Sweden.

PCT/SE2017/050618, Written Opinion of the International Searching Authority, dated Aug. 30, 2017, Patent-och registreringsverket Box 5055 S-10242 Stockholm, Sweden.

PCT/SE2016/050864, International Search Report, dated Nov. 30, 2016, Patent-och registreringsverket Box 5055 S-10242 Stockholm, Sweden.

PCT/SE2016/050864, Written Opinion of the International Searching Authority, dated Nov. 30, 2016, Patent-och registreringsverket Box 5055 S-10242 Stockholm, Sweden.

PCT/SE2016/050867, International Search Report, dated Dec. 14, 2016, Patent-och registreringsverket Box 5055 S-10242 Stockholm, Sweden.

PCT/SE2016/050867, Written Opinion of the International Searching Authority, dated Dec. 14, 2016, Patent-och registreringsverket Box 5055 S-10242 Stockholm, Sweden.

PCT/SE2016/050868, International Search Report, dated Dec. 16, 2016, Patent-och registreringsverket Box 5055 S-10242 Stockholm, Sweden.

PCT/SE2016/050868, Written Opinion of the International Searching Authority, dated Dec. 16, 2016, Patent-och registreringsverket Box 5055 S-10242 Stockholm, Sweden.

ANTENNA FEEDING NETWORK

FIELD OF THE INVENTION

The invention relates to the field of antenna feeding networks for multi-radiator antennas, which feeding network comprises at least one coaxial line.

BACKGROUND

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of one junction between e.g. 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at all ports.

A person skilled in the art would recognize that the feeding is fully reciprocal in the sense that transmission and reception can be treated in the same way, and to simply the description of this invention only the transmission case is described below.

The antenna feeding network may comprise a plurality of coaxial lines being substantially air filled, each coaxial line comprising a central inner conductor at least partly surrounded by an outer conductor with insulating air in between. The coaxial lines and the reflector may be formed integrally with each other in the sense that the outer conductors and the reflector are formed in one piece.

Antenna feeding networks of the closed type are known, i.e. feeding networks where the outer conductor in each coaxial line forms a cavity around the central inner conductor, i.e. encircles or forms a closed loop around the central inner conductor as seen in a cross section perpendicular to the longitudinal direction of the coaxial line, see FIG. 2. One disadvantage with such a closed antenna feeding network is that it may be difficult to assemble the antenna, e.g. properly arranging the central inner conductors and associated components such as support means for holding the inner conductors and connection means between the inner conductors inside the outer conductors. Furthermore, if movable dielectric elements are provided between the outer and inner conductors to provide a phase shifting functionality, the positions of such dielectric elements are not easily adjustable due to the closed outer conductors.

Antenna feeding networks of the open type are also known, i.e. feeding networks where the outer conductors in at least some coaxial lines are provided with openings, and thus do not completely surround or encircle the inner conductors. One example of such a feeding network is disclosed in WO2005/101566 in which an antenna feeding network having coaxial lines with a longitudinally extending opening along one side of the outer conductor, see FIG. 3. The inner conductors are supported by dielectric support means. Pairs of adjacent inner conductors may be interconnected by cross-over elements are arranged in openings through the wall between the inner conductors. This feeding network solves some of the problems associated with the closed type feeding network, in particular it is easier to assemble since direct access to the interior of the coaxial lines is provided. On the other hand, the longitudinally extending openings makes the antenna less mechanically stable and unwanted backwardly directed radiation may occur. Such unwanted radiation may reduce the antenna performance in terms of e.g. back- or sidelobe suppression. In antennas having two cross-polarized channels, it may also reduce cross-polarisation isolation and also isolation between the two channels. All those antenna parameters may be important to the performance of e.g. a cellular network in terms of e.g. interference and fading reduction. The problem with unwanted radiation may be solved at least in part by additional components in the form of conductive covers to cover the cross-over elements. Using such covers add to the cost and complexity of the feeding network however.

SUMMARY

An object of the present invention is to overcome at least some of the disadvantages of the prior art described above.

These and other objects are achieved by the present invention by means of an antenna feeding network comprising at least one coaxial line and a method for manufacturing such a coaxial line, and a multi radiator antenna comprising such an antenna feeding network according to the independent claims. Preferred embodiments are defined in the dependent claims.

According to a first aspect of the invention, an antenna feeding network for a multi-radiator base station antenna is provided. The feeding network comprises at least one or a plurality of substantially air filled coaxial line(s), each coaxial line comprising a central inner conductor, an elongated outer conductor surrounding the central inner conductor and an elongated rail element slidably or movably arranged inside the outer conductor. The rail element is longitudinally movable in relation to at least the outer conductor. The coaxial lines are preferably parallel.

In other words, the feeding network comprises at least one substantially air filled coaxial line, each comprising an inner conductor centrally arranged in an elongated outer conductor with air in-between, where each central inner conductor is at least partly surrounded by the corresponding outer conductor. Each outer conductor is formed by the walls defining an elongated compartment, the walls being made in a conductive material such as aluminum. The inner conductor and the rail element are thus arranged in the elongated compartment. The central inner conductor(s) may be substantially surrounded by the corresponding outer conductor in the sense that one or more openings are provided in the outer conductor, which may be small openings with limited extension in the longitudinal direction of the coaxial line, provided for example to allow electrical connection(s) to the inner conductor. In embodiments, the central inner conductor(s) may be encircled or completely surrounded by the outer conductor in the sense that the outer conductor forms a closed loop around the inner conductor as seen in a cross section perpendicular to the longitudinal direction of the coaxial line. The antenna feeding network may thus be of the closed type. The air between the conductors replaces the dielectric often found in coaxial cables between the inner and outer conductor. The outer conductor may in embodiments be a tube-shaped element having a square cross section. Further, the elongated rail element may be described as a bar-shaped element, i.e. an element which is substantially longer than wide, which is also wider than thick. It is understood that the term substantially air filled is used to described that the coaxial line is provided not solely with air in between the outer and inner conductors, but also with an elongated rail element which occupies part of the space inside the outer conductor which would otherwise be filled with air. In embodiments described below, the antenna feeding network may be provided with further components inside the outer conductor such as support elements and dielectric elements which also occupies part of the space inside the outer conductor which would otherwise be filled with air. The coaxial line is thus substantially, but not completely air filled in these embodiments. It is furthermore understood that although the antenna feeding network comprises at least one coaxial line provided with a rail element, the antenna feeding network may comprise further coaxial line(s) without such rail element(s).

According to a second aspect of the invention, a multi radiator antenna is provided. The multi radiator antenna comprises an antenna feeding network according to the first aspect of the invention, a reflector and a plurality of radiating elements such as dipoles arranged on said reflector.

According to a third aspect of the invention, a method for manufacturing a coaxial line for a multi-radiator base station antenna feeding network is provided. The method comprises providing a central inner conductor, an elongated outer conductor, and an elongated rail element adapted to be slidably movable inside the outer conductor. The method further comprises arranging the central inner conductor on the elongated rail element. The method further comprises sliding the elongated rail element with the inner conductor arranged thereon into the outer conductor such that the outer conductor together with the inner conductor form a substantially air filled coaxial line.

The invention is based on the insight that the disadvantages associated with the prior art may be overcome by providing each coaxial line with an elongated rail element which is movably arranged inside the outer conductor of the coaxial line. This allows the rail element to support the central inner conductor (at least) during assembly of the antenna feeding network such that the central inner conductor and, optionally other associated components, may be easily inserted or removed from the outer conductor.

In embodiments, at least one, or each, coaxial line of said at least one coaxial line is provided with at least one support element configured to support the central inner conductor, the support element being located between the outer and inner conductors. The rail element may be arranged inside the outer conductor in such a manner that the support element(s) is located between the rail element and the inner conductor. The support element(s) may not necessarily be in abutment or contact with the rail when the feeding network has been assembled. On the contrary, the support element(s) may be at a small distance from the rail element after assembly to avoid any friction there between when the rail is moved. The support element(s) may be supported by the outer conductor to define the positional relationship between the inner and outer conductors. During or prior to assembly or manufacturing however, the support element(s) may be placed on the rail element, i.e. in direct contact therewith.

It is understood that the directions referred to in this application relate to an antenna feeding network and multi-radiator base station antenna where a plurality of coaxial lines are arranged side by side in parallel to each other and also in parallel with a reflector on which the radiating elements are arranged. Longitudinally in this context refers to the lengthwise direction of the coaxial lines, and sideways refers to a direction perpendicular to the lengthwise direction of the coaxial lines. It is also understood that the term encircle used herein refers in general to completely surrounding an object, and is not limited to a circular surrounding shape.

In embodiments, the at least one support element is fixed in a longitudinal direction relative the inner conductor. The support element may further be configured to position the inner conductor relative the outer conductor. This may be achieved for example by adapting the size of the support element to the inner dimensions of the outer conductor such that the support element is in direct contact with the inner and outer conductors when the antenna feeding network is assembled.

In embodiments, at least one dielectric element is provided to at least partially fill the space between the inner and outer conductors in at least one of the coaxial lines to co-operate with the at least one coaxial line. The at least one dielectric element is attached to an elongated rail element arranged in the at least one coaxial line. In other words, one or a plurality of elongated rail elements may each be provided with one or a plurality of dielectric elements attached thereto. At least one elongated rail element may thus be provided with at least two dielectric elements being attached thereto, which dielectric elements are spaced apart from each other (as seen in the longitudinal direction). Preferably, at least two rail elements are each provided with at least one dielectric element, wherein at least one of these rail elements is provided with at least two dielectric elements. These embodiments are advantageous since they allow the position(s) of the dielectric element(s) to be conveniently adjusted by moving the rail element(s). The at least one dielectric element may act co-operate with the at least one coaxial line to provide a phase shifting arrangement. The phase shift is achieved by moving the dielectric element that is located between the inner conductor and the outer conductor of the coaxial line. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors. If the dielectric element is moved in such a way that the outer conductor will be more filled with dielectric material, the phase shift will increase. The at least one dielectric element may have a U-shaped profile such as to partly surround the inner conductor in order to at least partly fill out the cavity between the inner and outer conductors.

In embodiments, the feeding network comprises at least two, or a plurality of, substantially air filled coaxial lines, each comprising a central inner conductor and an elongated outer conductor surrounding the central inner conductor. The outer conductor is formed by the walls defining an elongated compartment, the walls being made in a conductive material such as aluminum. At least one of the coaxial lines, or each coaxial line, comprise an elongated rail element slidably arranged inside the outer conductor, i.e. within the compartment, the rail element being longitudinally movable in relation to the conductors. The inner conductors of at least two coaxial lines may be interconnected by means of a connector device. At least one rail element is provided with at least one dielectric element being attached thereto. A splitter/combiner with differential phase shift may be achieved by means of a pair of interconnected coaxial lines provided with a rail element with a dielectric element in at least one of the coaxial lines, where the phase shift is adjustable by moving the rail element.

In embodiments, the feeding network comprises at least two, or a plurality of, substantially air filled coaxial lines formed using a common elongated compartment, the walls defining the elongate compartment being used as outer conductors which each surrounds a respective inner conductor. The inner conductors are arranged consecutively and at a distance from each other (as seen in the longitudinal direction of the outer conductor) therein. A common elongated rail element is slidably arranged within the compartment, and is provided with at least two dielectric elements, each being configured to co-operate with a corresponding inner conductor of the at least two coaxial lines formed within the common compartment to form at least two phase shifting arrangements. It is understood that the at least two phase shifting arrangements comprising dielectric elements attached to the common rail element move synchronously when the rail is moved, thus resulting in equal phase shift in the corresponding at least two coaxial lines.

The two embodiments described above are advantageously combined to form a feeding network having at least four coaxial lines. The first and second coaxial lines each comprise a central inner conductor arranged in an elongated compartment, the walls defining the elongate compartment being used as an outer conductor surrounding the central inner conductor. An elongated rail element is slidably arranged within the compartment of the second coaxial line, and optionally also in the first coaxial line. The rail element in the second coaxial line may be provided with a dielectric element to provide a phase shift arrangement. The third and fourth coaxial lines are formed using a common elongated compartment as described above and a common elongated rail element provided with at least two dielectric elements to form second and third phase shifting arrangements. Connector devices are provided between the first and second coaxial lines and between the second coaxial line and each of the third and fourth coaxial lines to provide a feeding network which distributes a signal to/from the first coaxial line to the ends of the third and fourth coaxial lines, to which four radiators or dipoles are connectable. In further embodiments, the feeding network may comprise an additional common compartment provided with four inner conductors and an elongated rail element therein to form fifth, sixth, seventh and eighth coaxial lines, connectable to eight dipoles. The corresponding rail element may, but does not necessarily need to be, provided with at least four dielectric elements therein to provide further phase shifting arrangements. In yet other embodiments, the feeding network comprises yet another common compartment provided with eight inner conductors, connectable to sixteen dipoles, and optionally yet another common compartment provided with sixteen inner conductors, connectable to thirty two dipoles.

In embodiments, the outer conductor is provided with guiding means configured to guide the rail element inside the outer conductor. The guiding means may comprise at least one longitudinally extending protrusion, ridge or groove provided on the inside or inner wall(s) of the outer conductor. For example, the guiding means may comprise one ridge on each inner side wall of the outer conductor arranged at a distance from the bottom surface of the outer conductor, which ridges extend in parallel along the whole or essentially the whole length of the outer conductor, such that the rail element is guided from below by the bottom surface and from above by the ridges. Alternatively, the guiding means may comprise pairs of ridges on each inner side wall, which ridges extend in parallel along the whole or essentially the whole length of the outer conductor, such that the rail element is guided between the ridges.

In an antenna arrangement, the radiators may be positioned in a vertical column. The electrical antenna tilt angle is determined by the relative phases of the signals feeding the radiators. The relative phases can be fixed giving the antenna a predetermined tilt angle, or the relative phases can be variable if a variable tilt angle is required. In embodiments of the antenna feeding network, it is provided with means to achieve more phase shift in one coaxial line than in another, i.e. to control the relative phases, in order to control the electrical antenna tilt angle.

This may be achieved by having dielectric elements of different sizes, and/or by moving the rails and corresponding dielectric elements at different relative speeds, and/or by using dielectric elements with different dielectric constants. In such an embodiment, the antenna feeding network may comprise a plurality of air filled coaxial lines and means for moving at least two rail elements of the coaxial lines simultaneously at different speeds. Because the rail elements and the dielectric elements attached thereto move at different speed, and/or because the dielectric elements are of different sizes and/or have different dielectric constant, more phase shift will be achieved in at least one of the coaxial lines than in at least one other of the coaxial lines. The means for moving may comprise a longitudinally extending rod and at least first and second connecting elements, each connecting element being connected to a corresponding rail element, each connecting element being provided with an internally threaded portion, the internally threaded portions being configured to co-operate with corresponding (externally) threaded segments or portions of the rod, wherein the threaded segments or portions of the rod have different pitch from each other such that the first and second connecting elements move at different speed when the rod is rotated. In other words, the internally threaded portion of the first connecting element has a first pitch and is engaged with a first threaded segment on the rod having the first pitch, and the internally threaded portion of the second connecting element has a second pitch, which is different from the first pitch, and is engaged with a second threaded segment on the rod having the second pitch.

The means for moving may further comprise means for manually rotating said longitudinally extending rod, for example a handle or knob, such that the rod may be rotated or actuated by hand. Alternatively, the means for moving may comprise at least one electric motor arranged to rotate said longitudinally extending rod and optionally also means for electrically controlling said electric motor from a distance. This is advantageous since it is possible to remotely change the position of the dielectric elements, thus remotely controlling the downtilt of the antenna.

In embodiments, the antenna feeding network is provided with at least one holding element configured to attach or fixate the inner conductor to the outer conductor. The holding element may be of the type described in applicants co-pending application titled "Antenna feeding network comprising at least one holding element".

In further embodiments, an electrically conductive reflector is integrally formed with the outer conductors of the coaxial lines.

In embodiments, each inner conductor is fixedly arranged inside the corresponding outer conductor or compartment.

All embodiments described above may also form parts of embodiments of a multi radiator antenna according to the second aspect of the invention.

In embodiments of a method according the third aspect of the invention, the method is for manufacturing an antenna feeding network according to the first aspect of the invention or embodiments thereof, which method comprises performing the steps of providing, arranging and sliding at least one time to provide the at least one substantially air filled coaxial line. Further embodiments of the method comprises performing steps to achieve features corresponding to any of the above described embodiments of the antenna feeding network.

In further embodiments of the method, the step of arranging comprises arranging the central inner conductor on said elongated rail element at a distance therefrom using at least one support element. In yet further embodiments, the method comprises providing at least one dielectric element and attaching the at least one dielectric element to the elongated rail element. In yet further embodiments of the method, the method comprises the steps of providing at least one holding element, and, after the step of sliding, attaching the inner conductor to the outer conductor by means of the holding element.

BRIEF DESCRIPTION OF THE DRAWINGS

These and other aspects of the present invention will now be described in more detail with reference to the appended drawings, which show presently preferred embodiments of the invention, wherein.

DETAILED DESCRIPTION

Figure 1:
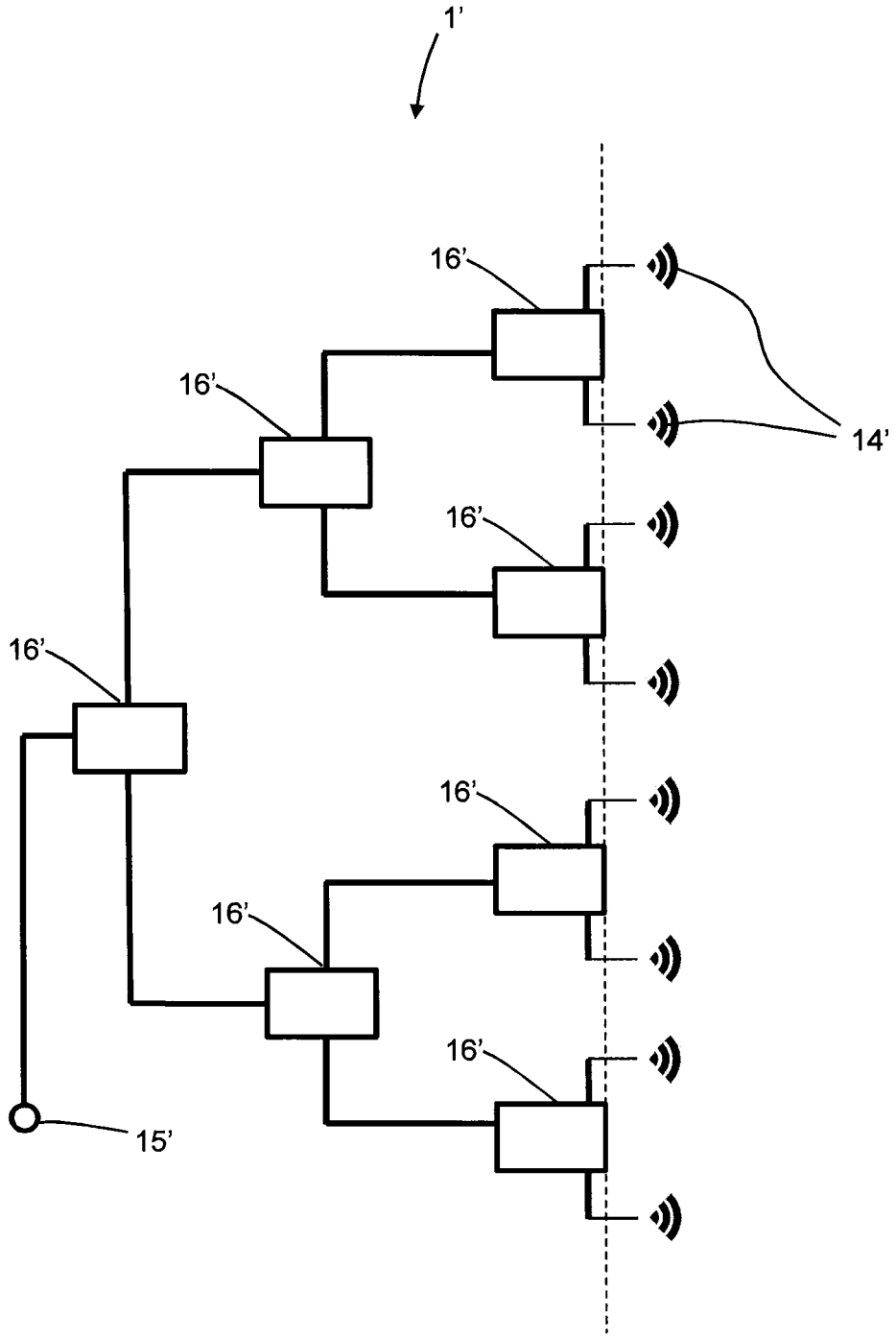
FIG. 1 shows a schematic view of an antenna feeding network for a multi radiator antenna.

FIG. 1 schematically illustrates an antenna arrangement 1 comprising an antenna feeding network 1, an electrically conductive reflector, which is shown schematically in FIG. 1, and a plurality of radiating elements 14'. The radiating elements 14' may be dipoles. The antenna feeding network 1 connects a coaxial connector 15' to the plurality of radiating elements 14' via a plurality of lines which may be coaxial lines, which are schematically illustrated in FIG. 1. The signal to/from the connector 15' is split/combined using, in this example, three stages of splitters/combiners 16'.

Figure 2:
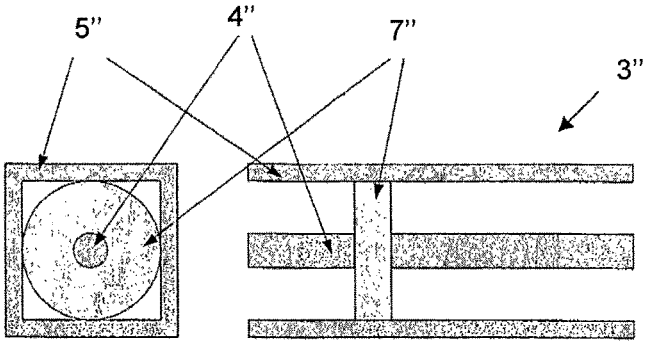
FIG. 2 shows a cross section view of a prior art coaxial line.

FIG. 2 shows a cross section view of a prior art coaxial line 3", where the outer conductor 5" is formed as a square cross section tube, and the inner conductor 4" is supported by dielectric support means 7".

Figure 3:
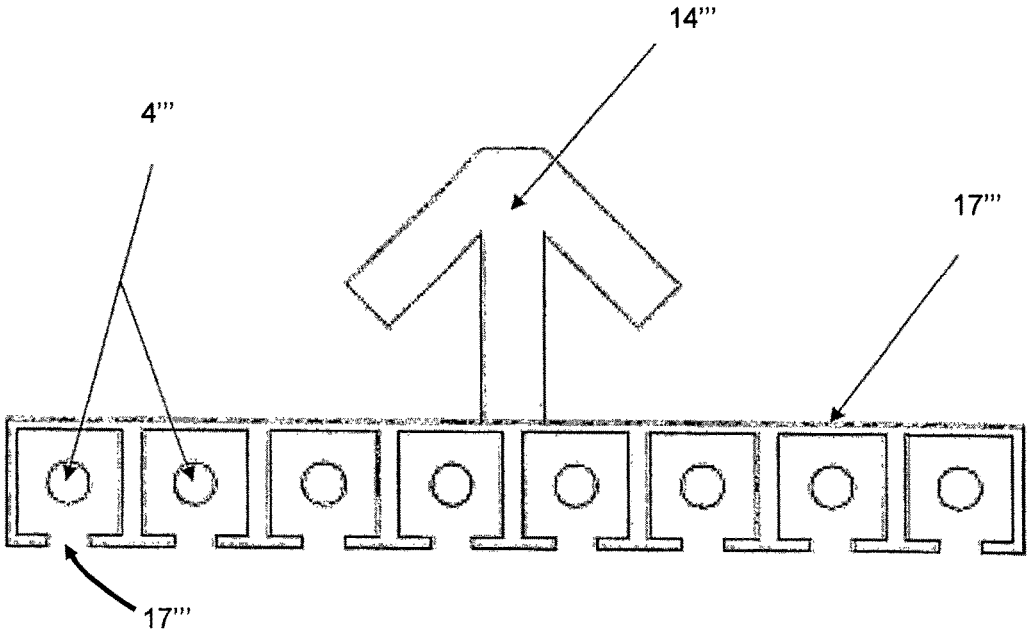
FIG. 3 shows a schematic cross section view of a prior art multi-radiator antenna, where the outer conductors of the coaxial lines combine to form a reflector for the radiators.

FIG. 3 shows a schematic cross section view of a prior art multi-radiator antenna, having an antenna feeding network comprising a plurality of coaxial lines, each having an outer conductor with a substantially square cross section and an inner conductor 4''' arranged in the outer conductor. The antenna feeding network is of the open type, i.e. each of the coaxial lines is provided with a longitudinally extending opening 17''' along one side of the outer conductor, in this case along the bottom of the outer conductor. The antenna further comprises a reflector 17''' which is formed by upper outer surfaces of the outer conductors of the coaxial lines, and radiators/dipoles 14''' arranged in parallel (only one is seen in the figure) on the reflector. The antenna feeding network and the reflector form a self-supporting structure.

Figure 4:
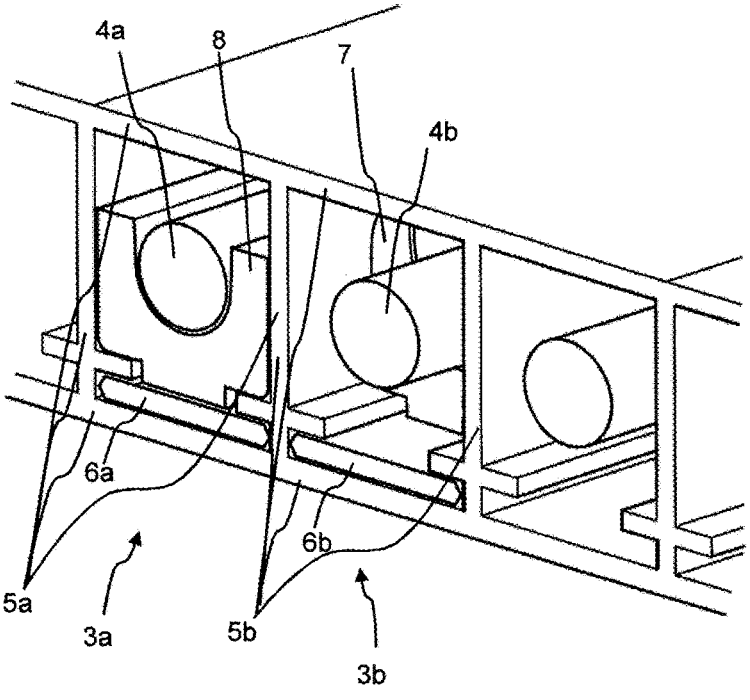
FIG. 4 shows a detail view of an antenna feeding network according to an embodiment of the first aspect of the invention.

FIG. 4 shows a detail view of an antenna feeding network according to an embodiment of the first aspect of the invention. The feeding network comprises a plurality of parallel coaxial lines. The figure shows two coaxial lines 3*a*, 3*b* which each comprise a central inner conductor 4*a*, 4*b*, an elongated outer conductor 5*a*, 5*b* forming a cavity or compartment around the central inner conductor, and an elongated rail element 6*a*, 6*b* slidably arranged inside the outer conductor. The outer conductors 5*a*, 5*b* have square cross sections and are formed integrally and in parallel to form a self-supporting structure. The wall which separates the coaxial lines 3*a*, 3*b* constitute vertical parts of the outer conductors 5*a*, 5*b* of both lines. The rail elements 6*a*, 6*b* are longitudinally movable relative the outer conductors. In the figure is illustrated a support element 7 which is arranged between the rail element 6*b* and the inner conductor 4*b*, and also between the inner and outer conductors. Furthermore, the coaxial line 3*a* is provided with a dielectric element 8 which is attached to the elongated rail element 6*a* and is configured to co-operate with the coaxial line 3*a*. The dielectric element 8 has a U-shaped cross section and is arranged around the inner conductor 4*a* such that it partially surrounds the inner conductor from below and fills most of the cavity between the conductors. Arranging the dielectric element 8 in the cavity between the inner and outer conductor forms a phase shifting device arranged to adjust the phase of signals in coaxial line 3*a*. Since the dielectric element 8 is attached to the rail element 6*b*, the phase may be adjusted by moving or sliding the rail element longitudinally 6*a* until the desired position and phase shift is achieved.

Figure 5:
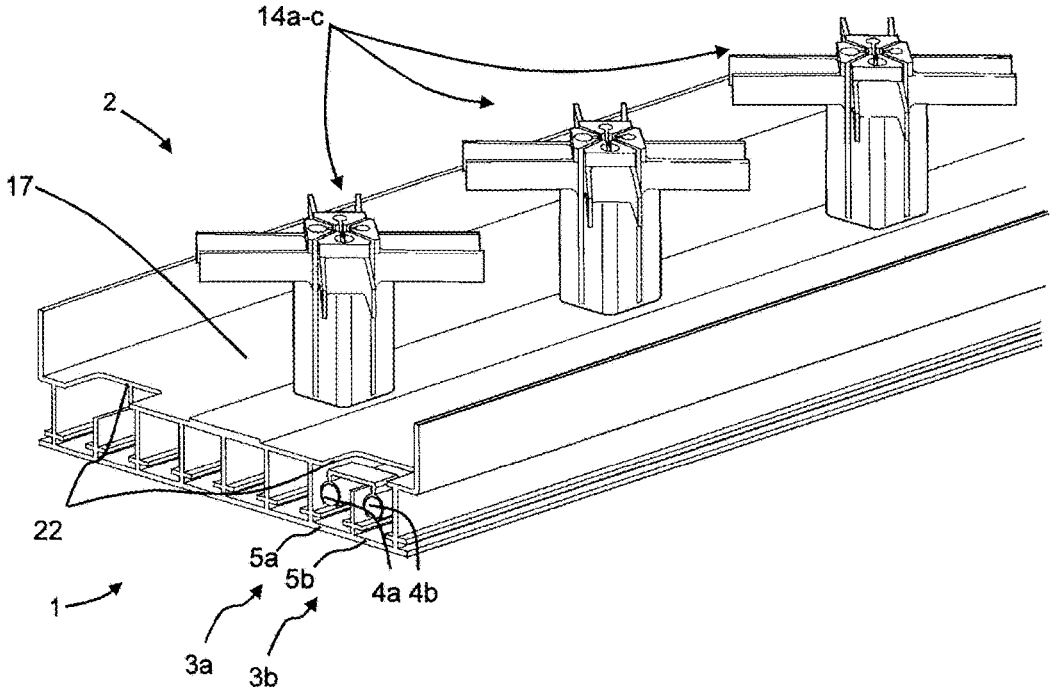
FIG. 5 shows a view of a multi radiator antenna according to an embodiment of the second aspect of the invention.

FIG. 5 shows a view of a multi radiator antenna according to an embodiment of the second aspect of the invention. The antenna 2 comprises an antenna feeding network 1, a reflector 17 and three radiating elements or dipoles 14*a-c* arranged on the reflector. The antenna feeding network is provided with coaxial lines 3*a*, 3*b* having central inner conductors 4*a*, 4*b* and outer conductors 5*a*, 5*b*. The description above with reference to FIG. 4 also applies to this feeding network, although no rail elements are shown in FIG. 5. In this figure, it is illustrated how the coaxial lines are integrally formed with the reflector in the sense that the reflector 17 is formed by the upper walls of the outer conductors. Each outer conductor is formed by the walls defining an elongated compartment, the walls being made in a conductive material such as aluminum. The inner conductors and the rail elements are thus arranged in elongated compartments. Although only two of the compartments are provided with inner conductors in FIG. 5, it is realized that one or a plurality of the shown compartments may also be provided inner conductors to form coaxial lines. It is further realized that the number of inner conductors (two) and number of radiators (three) shown are only for illustrative purposes, and that further inner conductors may be used to provide a splitting/combing antenna feeding network of the type shown in FIG. 1. Outer conductors of the antenna feeding network 1 are provided with openings 22. The openings 22 have an elongated shape in the lateral direction and are solely provided to allow electrical interconnection between inner conductors. The openings are thus of quite short extension in the longitudinal direction. The outer conductors thus substantially surround the inner conductors, and the antenna feeding network may be described as a substantially closed type of antenna feeding network.

Figure 6:
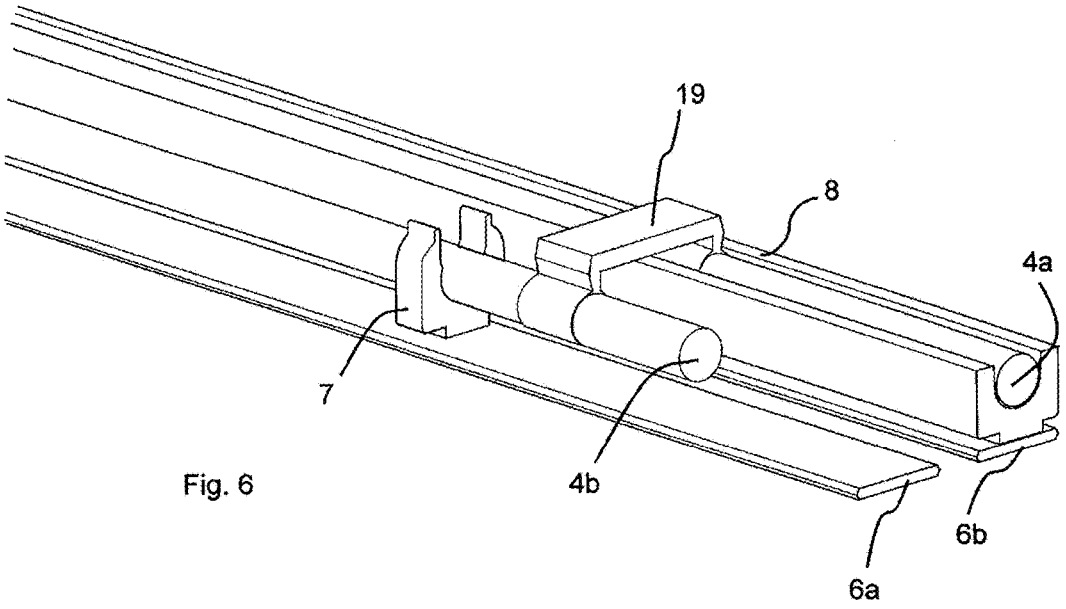
FIG. 6 shows parts of an antenna feeding network according to an embodiment of the first aspect of the invention.

FIG. 6 shows parts of the antenna feeding network shown in FIG. 4. The support element 7 may be held in the desired axial position by being arranged in a circumferential recess or groove (not shown) of the inner conductor 4*b*. The support element has a circular through hole provided with a side opening, and is made from a flexible plastic material such that the inner conductor may be inserted into the through hole via the side opening, such that the inner conductor and the support element is engaged with each other as shown in the figure. The elongated dielectric element 8 on the other hand is attached to the rail element 6*b* (and thereby axially fixated). Thus, the support element(s) is axially fixated relative to the inner conductor, while the dielectric element(s) is axially fixated to the rail element. Prior to inserting the inner conductors, rail elements, support element(s) and dielectric element(s) into the outer conductors, the inner conductors and the support element are placed on top of the rail element, for example as illustrated in FIG. 6. Thereafter, the inner conductors, rail elements, support element(s) and dielectric element(s) are pushed into corresponding outer conductors as a single unit. Since the support element 7 is axially fixated to the inner conductor 4*b*, their relative positions are maintained after having been inserted into the corresponding outer conductor. After the inner conductors, rail elements, support element(s) and dielectric element(s) have been inserted into the outer conductors, each inner conductor is advantageously attached or fixated to the corresponding outer conductor, for example by means of at least one holding element. After the inner conductors have been attached or fixated, the rail elements may be moved back and forth independently of the inner conductors. It is understood that only axial portions of the inner conductors and rails are shown, and that at least one support element corresponding to that of inner conductor 4*b* may also be attached to inner conductor 4*a*, and that at least one rail dielectric element corresponding to element 8 may also be attached to the rail element 6*a*.

The connector device 19 and the inner conductors 4*a*, 4*b* together form a splitter/combiner. When operating as a splitter, the inner conductor 4*b* is part of the incoming line, and the two ends of the inner conductor 4*a* are the two outputs of the splitter. The dielectric element 8 can be moved along the inner conductor 4*a*, which forms first and second coaxial output lines on opposite sides of the connector device 19 (together with an outer conductor which is not shown). The dielectric element thus has various positions along those coaxial output lines.

We first consider the case when the dielectric element 8 is placed in a central position, equally filling the first and second output coaxial lines. When a signal is entered at the input coaxial line 4*b*, it will be divided between the first output coaxial line and the second output coaxial line, and the signals coming from the two output coaxial lines will be equal in phase. If the dielectric element 8 is moved in such a way that the first output coaxial line will be more filled with dielectric material than the second output coaxial line, the phase shift from the input to the first output will increase. At the same time the second output coaxial line will be less filled with dielectric, and the phase shift from the input to the second output will decrease. Hence, the phase at the first output will lag the phase at the second output. If the dielectric part is moved in the opposite direction, the phase of the first output will lead the phase of the second output. The splitter/combiner may thus be described as a differential phase shifter.

Figure 7:
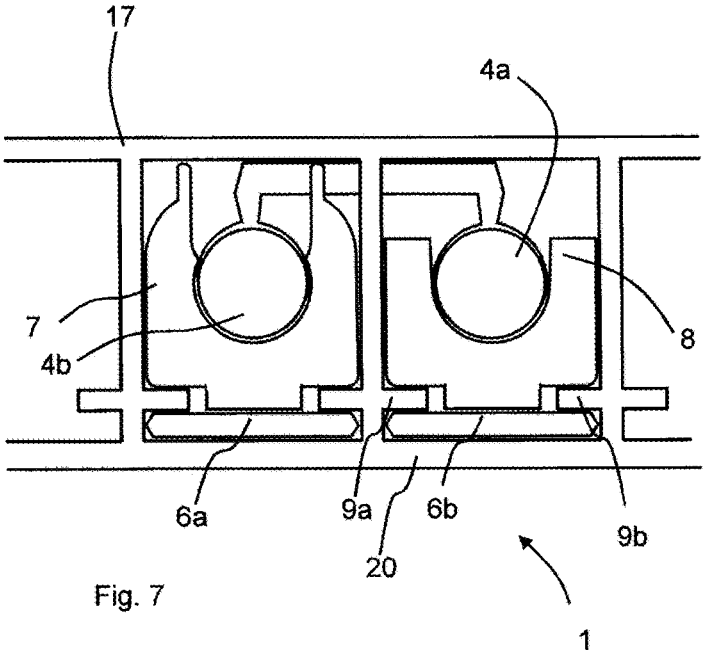
FIG. 7 shows a cross section view of an antenna feeding network according to an embodiment of the first aspect of the invention.

FIG. 7 shows a detailed cross section view of the antenna feeding network shown in FIG. 4. In FIG. 7, it is clearly illustrated how the outer conductor is provided with guiding means configured to guide the rail element inside the outer conductor. The guiding means comprises one longitudinally extending protrusion or ridge 9*a*, 9*b* on each inner side wall of the outer conductor arranged at a distance from the bottom surface of the outer conductor corresponding to the thickness of the rail element 6*b*. The ridges extend in parallel along the whole or essentially the whole length of the outer conductor (in the depth direction as shown in the figure), such that the rail element is guided from below by the bottom surface 20 and from above by the ridges 9*a*, 9*b*.

Figure 8:
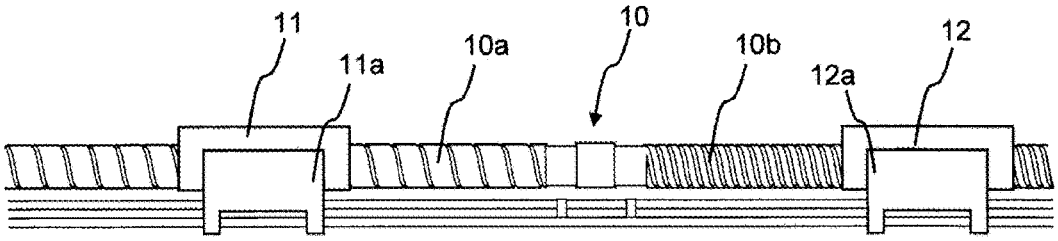
FIG. 8 shows means for moving two rail elements in an antenna feeding network according to an embodiment of the first aspect of the invention in a partial cross section view from the side.

FIG. 8 shows means for moving two rail elements in an antenna feeding network according to an embodiment of the first aspect of the invention. The means for moving the two rail elements of the coaxial lines is configured to move the rail elements simultaneously at different speeds. The means for moving comprises a longitudinally extending rod 10 and at least first and second connecting elements 11, 12, each connecting element being provided with an internally threaded portion 11*a*, 11*b*, the internally threaded portions being configured to co-operate with corresponding (externally) threaded segments or portions 10*a*, 10*b* of the rod 10, wherein the threaded segment or portion 10*a* of the rod has a greater pitch than the other threaded segment or portion 10*b*, such that the first connecting element 11 moves at a greater speed than the second connecting element 12 when the rod is rotated. The connecting elements 11, 12 are connectable to respective rail elements (not shown in the figure) through elongated slots in the outer conductors. The rod may be rotated manually or using electric motors controlled by a controlling device such as micro-controller. When using electric motors, the rails, and hence the downtilt of the antenna, can be controlled remotely. The remote control can be achieved e.g. by connecting the motor and micro-controller to a cellular base station, or some other means for control. The means for moving two rail elements illustrated in FIG. 8 may be combined with two or more splitter/combiners of the differential phase shifting type illustrated in FIG. 6. Thus, the means for moving may be configured to move a rail element 6*b* and dielectric element 8 of a first splitter/combiner simultaneously and at a different speed than a rail element and dielectric of a second splitter/combiner. Such a combination including a plurality of differential phase shifters may be used in an antenna arrangement to provide a variable electrical tilt angle.

Figure 9:
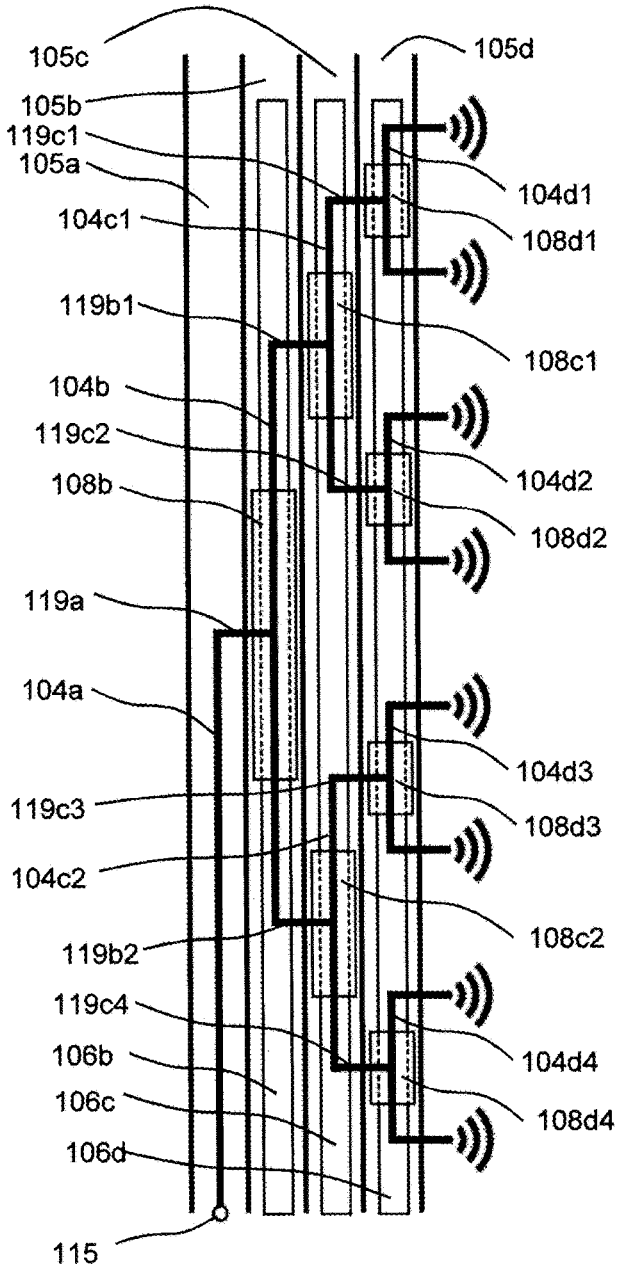
FIG. 9 shows a schematic view of an antenna feeding network according to an embodiment of the first aspect of the invention.

FIG. 9 shows a schematic cross section view of an antenna feeding network. The feeding network comprises eight coaxial lines. The figure shows four compartments 105*a*-105*d* formed in parallel in an integral self-supporting structure. The walls which separate the compartments constitute vertical parts of the outer conductors. In each of the first and second compartments 105*a*, 105*b*, a single inner conductor 104*a*, 104*b* is arranged, forming first and second coaxial lines together with the walls defining the compartment. In the compartment 105*c*, two inner conductors 104*c*1, 104*c*2 are arranged spaced apart from each other as seen in the longitudinal direction forming third and fourth coaxial lines using the walls defining compartment 105*c* as outer conductors. In the fourth compartment 105*d*, four inner conductors 104*d*1-104*d*4 are arranged spaced apart from each other as seen in the longitudinal direction forming fifth-eighth coaxial lines using the walls defining compartment 105*d* as outer conductors.

The inner conductor 104*a* forms part of an incoming line 115. The inner conductor 104*a* of the first coaxial line is interconnected to the inner conductor 104*b* of the second coaxial line by means of a connector device 119*a*. Opposite ends of the inner conductor 104*b* of the second coaxial line are interconnected to the inner conductors 104*c*1 and 104*c*2, respectively, by means of connector devices 119*b*1 and 119*b*2. Opposite ends of the inner conductor 104*c*1 of the third coaxial line are interconnected to the inner conductors 104*d*1 and 104*d*2, respectively, by means of connector devices 119*c*1 and 119*c*2. The inner conductor 104*c*2 is connected to the inner conductors 104*d*3 and 104*d*4 by means of connector device 119*c*3 and 119*c*4 in the same manner. The connector devices 119*a*, 119*b*1-*b*2, 119*c*1-*c*3 may be of the same type shown in FIG. 6 and described above. Each of the inner conductors 104*b*, 104*c* and 104*d* may be considered to be a part of separate coaxial output lines on opposite sides of the corresponding connector device together with the outer conductors formed by the walls defining the respective surrounding compartment.

The second, third and fourth compartments 105*b*-*d* are each provided with an elongated rail element 106*b*-*d* slidably arranged inside the corresponding compartment. The rail elements are longitudinally movable in the compartment. The rail element 106*b* in the second compartment is provided with a dielectric element 108*b* which is attached thereto such that the first and second coaxial lines form a splitter/combiner with differential phase shift as described above with reference to FIG. 6. The rail element 106*c* in the third compartment is provided with two dielectric elements 108*c*1, 108*c*2 which are attached thereto in a longitudinally spaced apart manner. The dielectric elements 108*c*1, 108*c*2 are configured to co-operate with a respective coaxial line formed with inner conductor 104*c*1, 104*c*2, such that the second coaxial line together with the third and fourth coaxial lines form two splitters/combiners with differential phase shift. In the same manner, the rail element 106*d* in the fourth compartment is provided with four dielectric elements 108*d*1-*d*4 which are attached thereto in a longitudinally spaced apart manner. The dielectric elements 108*d*1-*d*4 are configured to co-operate with a coaxial line formed with respective inner conductor 104*d*1-*d*4, such that the third and fourth coaxial lines together with the fifth-eighth coaxial lines form four splitters/combiners with differential phase shift. In other embodiments, the dielectric elements in the fourth compartment are omitted. The dielectric elements may be of the same type shown in FIG. 6 and described above.

As shown schematically in the figure, the ends of the fourth-eighth coaxial lines are each connectable to a corresponding radiator/dipole, thus forming a multi radiator antenna. The upper side of the outer conductors (not visible in the shown cross section view) may form a reflector on which the radiators are arranged in the same manner as shown in FIG. 5 and described above.

The embodiments shown in FIGS. 8 and 9 are advantageously combined to provide an antenna with electrically adjustable tilt. In such an embodiment, the means for moving are preferably configured to move the rail 106*c* (and the dielectric elements 108*c*1-*c*2) twice as fast/long as the rail 106*d* (and the dielectric elements 108*d*1-*d*4), and to move the rail 106*b* (and the dielectric element 108*b*) twice as fast/long as the rail 106*c*, i.e. four times as fast/long as the rail 106*d*.

The text above describes one possible, but not limiting, embodiment of the invention. Other embodiments are possible, e.g. with other numbers of radiators such as 2, 4, 6, 10, 12, 14, 16, 18 etc. Embodiments with odd number of radiators are also possible.

In such other implementations, the movement of the different rails will not be exactly twice or four times compared to that of the slowest moving rail.

The description above and the appended drawings are to be considered as non-limiting examples of the invention. The person skilled in the art realizes that several changes and modifications may be made within the scope of the invention. For example, the number of coaxial lines may be varied, the number of radiators or dipoles may be varied, the number of coaxial lines provided with rail elements may be varied, the number of coaxial lines provided with dielectric elements and/or support elements may be varied, and the shape of the support element(s) and dielectric element(s) may be varied. Furthermore, the reflector does not necessarily need to be formed integrally with the coaxial lines, but may on the contrary be a separate element. The scope of protection is determined by the appended patent claims.

The invention claimed is:

1. An antenna feeding network for a multi-radiator antenna, said feeding network comprising at least one substantially air filled coaxial line, each coaxial line comprising:

a central inner conductor;

an elongated outer conductor surrounding the central inner conductor; and an elongated rail element slidably arranged inside the outer conductor, said rail element being longitudinally movable in relation to said conductors, wherein at least one elongated rail element is provided with at least two dielectric elements being attached thereto.

2. The antenna feeding network according to claim 1, wherein at least one coaxial line further comprises at least one support element configured to support said central inner conductor, said support element being arranged between said inner and outer conductors.

3. The antenna feeding network according to claim 1, wherein said at least two dielectric elements are configured to co-operate with the at least one coaxial line to provide a phase shifting arrangement.

4. The antenna feeding network according to claim 1, wherein said at least two dielectric elements have a U-shaped profile such as to partly surround the inner conductor of said at least one coaxial line and to at least partly fill out the cavity between the inner and outer conductors of said at least one coaxial line.

5. The antenna feeding network according to claim 1, wherein said outer conductor is provided with guiding means configured to guide the rail element inside the outer conductor.

6. The antenna feeding network according to claim 5, wherein said guiding means comprises at least one longitudinally extending protrusion provided on the inside of said outer conductor.

7. The antenna feeding network according to claim 1 comprising a plurality of said coaxial lines and means for moving at least two rail elements of said coaxial lines simultaneously at different speed.

8. The antenna feeding network according to claim 7, wherein said means for moving comprises a longitudinally extending rod and at least first and second connecting elements, each being mechanically connected to respective at least first and second rail elements of said at least two rail elements, wherein each connecting element is provided with an internally threaded portion, said threaded portions being configured to co-operate with corresponding threaded segments of said rod, wherein said threaded segments have different pitch such that said first connecting element and first rail element moves at a different speed than said second connecting element and second rail element when said rod is rotated.

9. The antenna feeding network according to claim 8, wherein said means for moving comprises at least one electric motor arranged to rotate said longitudinally extending rod and means for electrically controlling said electric motor from a distance.

10. The antenna feeding network according to claim 2, wherein said support element is configured to position the inner conductor relative the outer conductor.

11. The antenna feeding network according to claim 1 further comprising at least one holding element configured to attach said inner conductor to said outer conductor.

12. The antenna feeding network according to claim 1, wherein said outer conductor are configured to form a cavity around the inner conductor.

13. The antenna feeding network according to claim 1, comprising at least two substantially air filled coaxial lines formed using a common elongated compartment, said elongated compartment being defined by walls forming outer conductors which surround at least two central inner conductors arranged consecutively within the compartment, wherein a common elongated rail element is slidably arranged within the compartment, and is provided with at least two dielectric elements, each being configured to co-operate with a corresponding inner conductor of the at least two coaxial lines formed in the common compartment to form at least two phase shifting arrangements.

14. The antenna feeding network according to claim 1, comprising at least two substantially air filled coaxial lines, wherein the inner conductors of at least two of said coaxial lines are interconnected by means of a connector device.

15. A multi radiator antenna comprising an electrically conductive reflector, at least one radiating element arranged on said reflector and an antenna feeding network, said radiating elements being connected to said antenna feeding network, and said antenna feeding network comprising at least one substantially air filled coaxial line, each coaxial line comprising:

a central inner conductor;

an elongated outer conductor surrounding the central inner conductor; and an elongated rail element slidably arranged inside the outer conductor, said rail element being longitudinally movable in relation to said conductors, wherein at least one elongated rail element is provided with at least two dielectric elements being attached thereto.

16. The multi radiator antenna of claim 15, wherein at least one coaxial line further comprises at least one support element configured to support said central inner conductor, said support element being arranged between said inner and outer conductors.

17. The multi radiator antenna of claim 15, wherein said at least two dielectric elements are configured to co-operate with the at least one coaxial line to provide a phase shifting arrangement.

18. The multi radiator antenna of claim 15, wherein said at least two dielectric elements have a U-shaped profile such as to partly surround the inner conductor of said at least one coaxial line and to at least partly fill out the cavity between the inner and outer conductors of said at least one coaxial line.

19. The multi radiator antenna of claim 15, wherein said outer conductor is provided with guiding means configured to guide the rail element inside the outer conductor.

20. The multi radiator antenna of claim 19, wherein said guiding means comprises at least one longitudinally extending protrusion provided on the inside of said outer conductor.

21. The multi radiator antenna of claim 15, comprising a plurality of said coaxial lines and means for moving at least two rail elements of said coaxial lines simultaneously at different speed.

22. The multi radiator antenna of claim 21, wherein said means for moving comprises a longitudinally extending rod and at least first and second connecting elements, each being mechanically connected to respective at least first and second rail elements of said at least two rail elements, wherein each connecting element is provided with an internally threaded portion, said threaded portions being configured to co-operate with corresponding threaded segments of said rod, wherein said threaded segments have different pitch such that said first connecting element and first rail element moves at a different speed than said second connecting element and second rail element when said rod is rotated.

23. The multi radiator antenna of claim 22, wherein said means for moving comprises at least one electric motor arranged to rotate said longitudinally extending rod and means for electrically controlling said electric motor from a distance.

24. A method for manufacturing a substantially air filled coaxial line for a multi-radiator base station antenna feeding network, said method comprising:

providing a central inner conductor, an elongated outer conductor, providing an elongated rail element adapted to be slidably movable inside the outer conductor, providing at least two dielectric elements; and attaching said dielectric elements to said elongated rail element, arranging said central inner conductor on said elongated rail element, sliding said elongated rail element with said inner conductor arranged thereon into said outer conductor such that said outer conductor together with said inner conductor form a substantially air filled coaxial line.

25. The multi radiator antenna of claim 15, further comprising at least one holding element configured to attach said inner conductor to said outer conductor.

26. The multi radiator antenna of claim 15, comprising at least two substantially air filled coaxial lines formed using a common elongated compartment, said elongated compartment being defined by walls forming outer conductors which surround at least two central inner conductors arranged consecutively within the compartment, wherein a common elongated rail element is slidably arranged within the compartment, and is provided with at least two dielectric elements, each being configured to co-operate with a corresponding inner conductor of the at least two coaxial lines formed in the common compartment to form at least two phase shifting arrangements.

27. The multi radiator antenna of claim 15, comprising at least two substantially air filled coaxial lines, wherein the inner conductors of at least two of said coaxial lines are interconnected by means of a connector device.

28. The multi radiator antenna of claim 24, wherein said support element is configured to position the inner conductor relative the outer conductor.

29. The method according to claim 24, wherein said arranging comprises arranging said central inner conductor on said elongated rail element at a distance therefrom using at least one support element.

30. The method according to claim 24 further comprising:

providing at least one holding element; and after said step of sliding, attaching said inner conductor to said outer conductor by means of said holding element.

* * * * *